United States Patent [19]

Langner

[11] 4,193,683

[45] Mar. 18, 1980

[54] METHOD AND APPARATUS FOR FILTERING DEVELOPING LIQUID IN A PHOTOCOPIER

[76] Inventor: Fred R. Langner, 12211 N. 82nd St., Scottsdale, Ariz. 85260

[21] Appl. No.: 935,660

[22] Filed: Aug. 21, 1978

[51] Int. Cl.[2] ..... G03G 15/10

[52] U.S. Cl. ..... 355/10; 210/348; 210/455; 210/496; 210/510

[58] Field of Search ..... 355/3 R, 10; 210/348, 210/416 R, 455, 473, 483, 496, 497 R, 510

[56] References Cited

U.S. PATENT DOCUMENTS

| | | | |
|---|---|---|---|
| 3,360,131 | 12/1967 | Witkowski | 210/496 X |
| 3,683,852 | 8/1972 | Yamaguchi et al. | 355/10 |
| 3,704,662 | 12/1972 | Johnson et al. | 354/324 |
| 3,722,559 | 3/1973 | Hoffman | 355/10 X |
| 3,733,124 | 5/1973 | Tanaka et al. | 355/10 |
| 3,957,368 | 5/1976 | Goshima et al. | 355/10 X |
| 3,983,837 | 10/1976 | Francis | 118/7 |
| 3,991,709 | 11/1976 | Sato et al. | 355/10 X |
| 4,081,371 | 3/1978 | Yarwood et al. | 210/455 X |
| 4,110,029 | 8/1978 | Goshima et al. | 355/10 |

*Primary Examiner*—Fred L. Braun
*Attorney, Agent, or Firm*—Thomas Hooker

[57] ABSTRACT

A photocopy machine and method where working solution flows down from a transfer drum into a trough-type filter and is then filtered as it flows into the main portion of a tank for subsequent recirculation over the transfer drum. The filter trough is preferably formed from a foamed polyurethane plastic and removes undesirable dust particles from the working solution. The filter also collects and filters gelled solution.

7 Claims, 5 Drawing Figures

Fig. 1
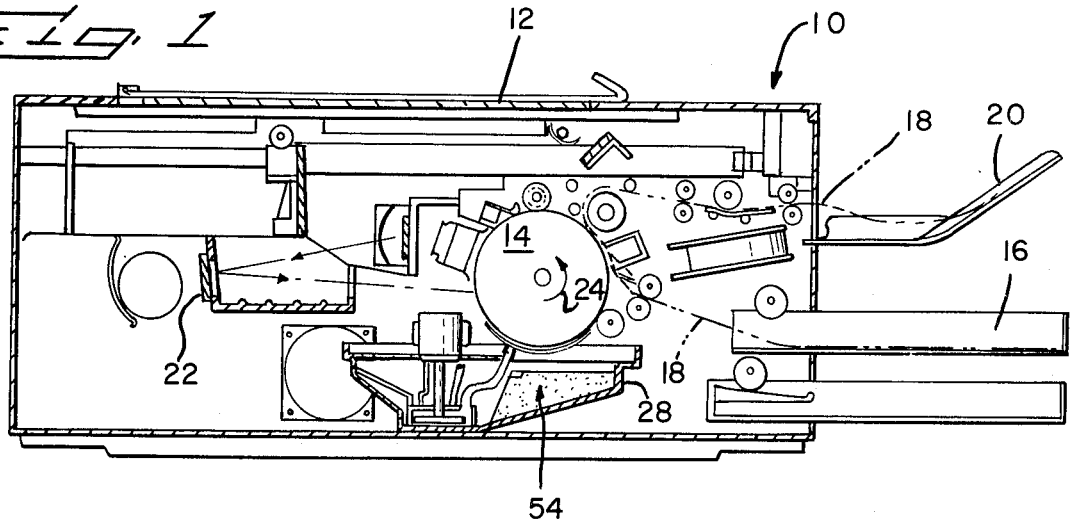
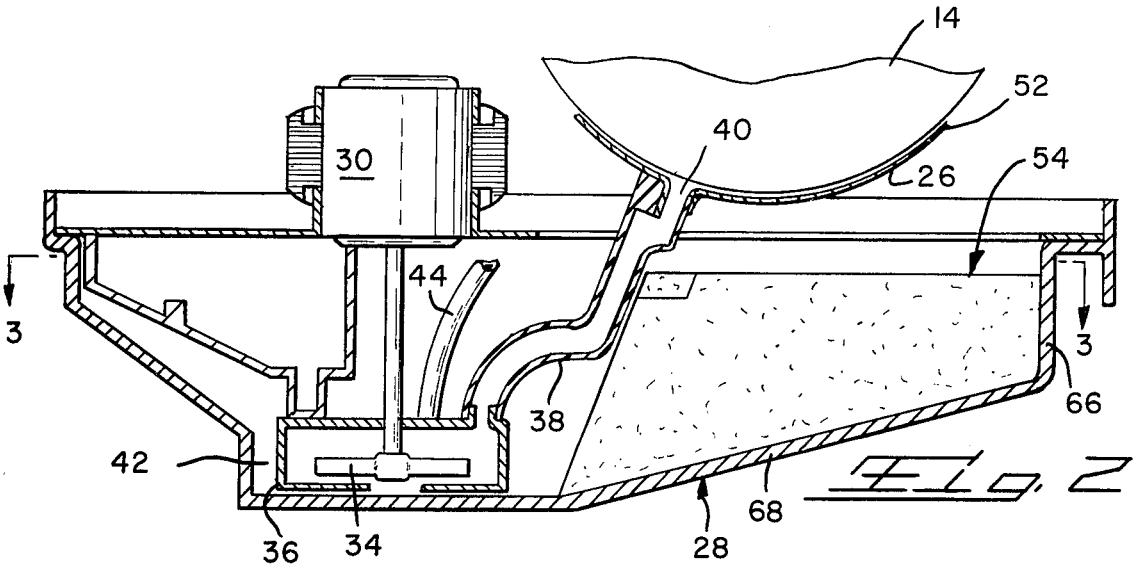
Fig. 2
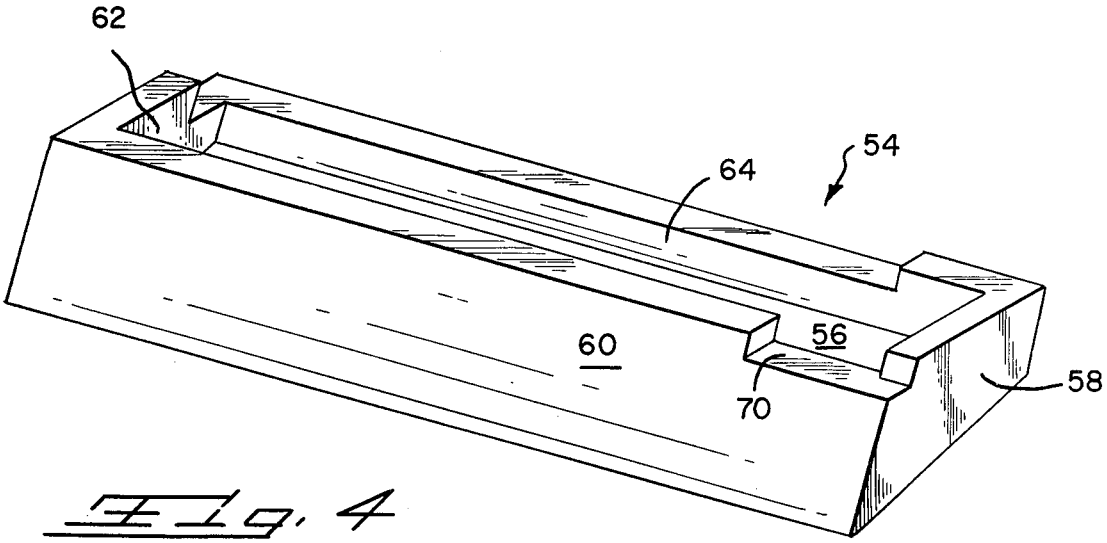
Fig. 4

METHOD AND APPARATUS FOR FILTERING DEVELOPING LIQUID IN A PHOTOCOPIER

This invention relates to an improved photocopy machine of the type using a rotary transfer drum where the image of the material to be copied is projected on the drum and is subsequently transferred to a copy sheet. During the copying process a working solution is flowed over the drum. Excess working solution drips from the drum down into a collection tank having pumps used to recirculate the solution over the drum. With continued use, the working solution picks up airborn dust particles which cause a decrease in efficiency of the copying process. The reduced efficiency of the copier causes a washed out appearance in the copy due to a loss of contrast. Extended use of the copier tends to gel the working solution. Gelled solution is conventionally collected in the tank below the drum where it may be undesirably recirculated over the drum.

The improved photocopier and method of the present invention provides for the elimination of the dirt and gel from the working solution by use of a trough-type filter located in the main working solution collecting tank immediately below the transfer drum. Working solution flowed over the drum falls down into and is collected by the filter trough. The solution seeps through the foamed polyurethane walls of the filter trough into the main collection tank for recirculation. As the fluid seeps through the fine openings in the walls the dust particles are filtered from it and the gel, which is heavier than the working solution, collects at the low point of the trough filter and is also flowed into and collected by the filter. The gel gradually flows into the filter from the lower most point upward through the increased filter volume, thereby assuring a progressive clogging of the filter and providing for initial large volume gel collection at the bottom of the filter. An over flow is provided at the top wall of the filter to permit direct discharge into the tank in the case the entire filter area becomes clogged and is unable to discharge working fluid faster than it is flowed into the filter trough.

Conventional photocopying machines of the type described require changing of the working solution after 20,000 to 30,000 copies have been made. Through use of a filter through the useful life of the working solution may be extended from to 30,000 to 50,000 copies before the solution must be changed. In addition to extension of the useful life of the working solution, the quality of the copy produced by the machine is greatly enhanced.

Prior photocopy apparatus such as those disclosed in U.S. Pat. No. 3,282,153 and in defensive publication T 940,022, use air filters for removing dirt from air before it is circulated within the interior of the copying machine. U.S. Pat. Nos. 3,554,641 and 3,614,223 show pressure filters for liquid used to develop photographic films.

Other objects and features of the invention will become apparent as the description proceeds, especially when taken in conjunction with the accompanying drawings illustrating the invention, of which there are two sheets.

IN THE DRAWINGS

FIG. 1 is a partially broken away side elevational view of a photocopier according to the invention;

FIG. 2 is a sectional view taken through a portion of the photocopier of FIG. 1;

FIG. 4 is a perspective view of the filter trough according to the invention.

Figure 3:
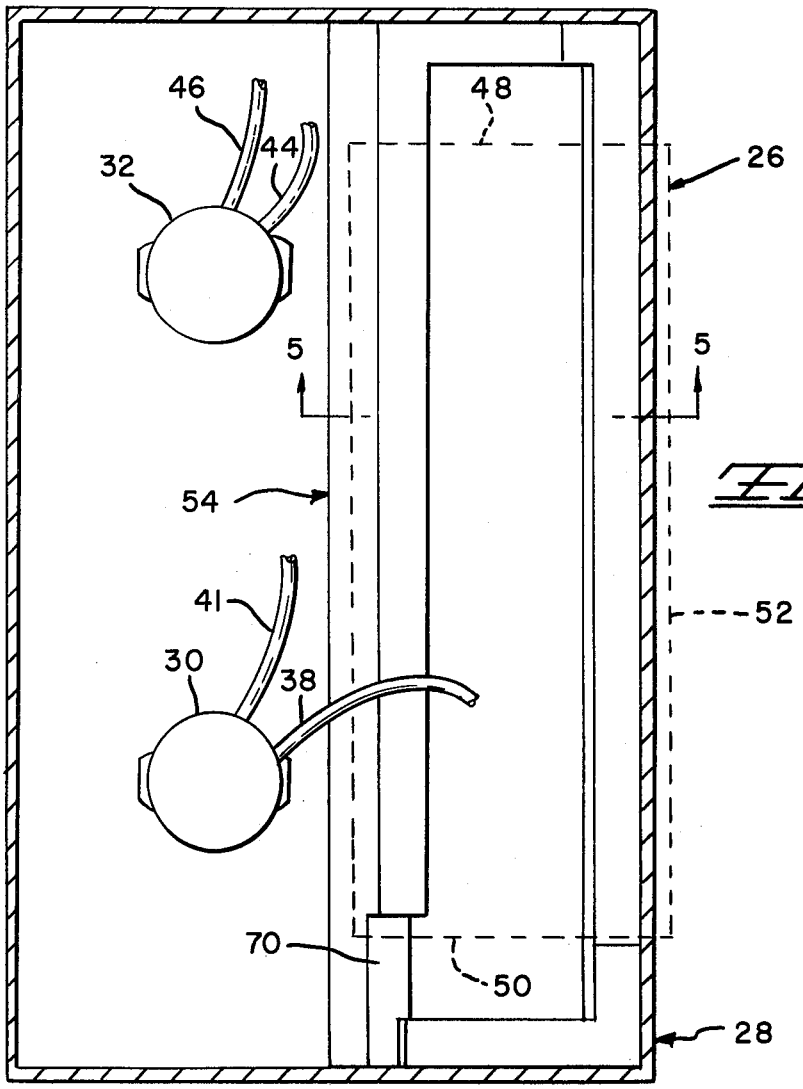
FIG. 3 is a sectional view taken along line 3—3 of FIG. 2.

Photocopier 10 reproduces copies of material placed on plate 12 by projecting the image of the material to be copied on the surface of the rotary transfer drum or roller 14 and then printing the image on a copy sheet drawn from supply cassette 16. The sheet from cassette 16 moves along path 18 past the right hand side of roller 14, as shown in FIG. 1, and then is deposited in exit tray 20. The image of the material to be copied is projected onto the left hand side of roller 14 from mirror 22 so that as the drum is rotated the image is moved past the developing device which includes a curved closely spaced electrode plate 26.

During the operation of the photocopier 10 a liquid toner or work solution is flowed over the work surface of drum 14 and between the drum and the electrode plate 26. A supply of the working solution is maintained in tank 28 located beneath and extending to the left of the drum 14, as illustrated in FIG. 2. A pair of electrically driven rotary pumps 30 and 32 are mounted on the top of the tank away from the drum 14. Each pump includes a drive shaft connected to an impeller 34 in the bottom of tank 28. The impellers are housed within pumping chambers 36. As illustrated in FIGS. 2 and 3, conduit 38 extends from the pumping chamber of pump 30 to a slot 40 extending across electrode plate 26. A second conduit 41 may lead from the pumping chamber of pump 30 back into the working solution collection portion 42 of tank 28. A discharge through this conduit serves to agitate the working solution in the tank to prevent gel formation.

A first conduit 44 extends from pump 32 to the top of drum 14 and discharges a flow of working solution onto the drum above the area on which the image is projected from mirror 22. A second conduit 46 extends from the pump and circulates the working fluid in the collection portion 42 of tank 28.

As best illustrated in FIG. 2, the working solution pumped through conduit 38 flows into the space between the electrode plate 26 and drum 14 and, with rotation of the drum, is drawn along the plate. Pump 30 provides sufficient fluid to fill this space and excess fluid flows out from the edges of the electrode 48 and 50 and side 52. This fluid flows down the outside of the electrode plate and drips into filter trough 54 located within the tank 28 beneath the drum and electrode plate.

Figure 5:
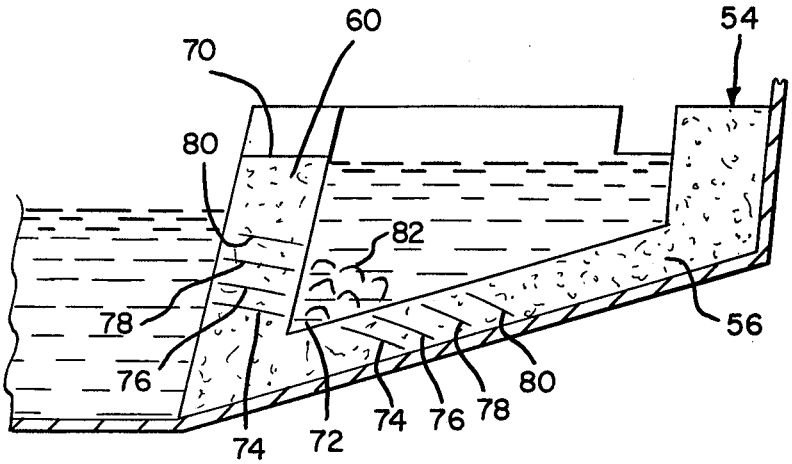
FIG. 5 is a sectional view taken along 5—5 of FIG. 3.

Filter trough 54, illustrated in FIG. 4, is preferably formed from a foamed polyurethane plastic and includes unitary bottom wall 56 and side walls 58, 60, 62 and 64. As illustrated in FIGS. 2 and 5, the trough fits snuggly within the portion of tank 28 beneath roller 14 with the exterior surface of side wall 64 against tank side wall 66, the exterior surface of bottom wall 56 against tank bottom wall 68 and the exterior surface of side wall 60 adjacent the structure extending from the lower surface of electrode 26.

The walls of filter trough 54 have an appreciable thickness to serve as a filter and collecting body for impurities in the working solution. The thickness of the side walls may be somewhat greater than the thickness of the bottom wall. The side walls may be $\frac{5}{8}$ inch thick.

During operation of photocopier 10, the working solution flows freely down into the filter trough 54 and normally fills the interior thereof to a level slightly below overflow recess or opening 70 formed through the top of the front side wall 60. The level of the fluid in the filter trough 54 is higher than the level of the fluid in the collecting portion 42 of the working fluid tank 28 so that a pressure differential is maintained across the walls of the trough to gravity flow the working fluid through these walls with the resultant desirable filtration of impurities and gel. Continuous operation of the machine provides a continuous supply of working fluid to the trough and results in continuous filtration of the working fluid thereby assuring that newly picked up particles and newly formed gel are filtered from the solution flowing back into tank 28. These particles tend to impair the quality of the copy produced by the photocopying machine. In one test a filter trough was installed in a photocopying machine charged with dirty working fluid. Copy initially produced by the machine had low contrast and was of poor quality. After the machine was operated with the filter trough in place and made fifty copies, the working fluid had been filtered sufficiently to remove the foreign particles. The copies produced were of high quality and had high contrast. Further operation of the machine produced high quality copies. In normal operation, the filter trough may be used for from about 30,000 to 50,000 copies before it must be changed.

The working fluid in photocopiers of the type described has a tendency, in time, to coagulate and gel. Gelled working fluid is heavier than the remaining liquid and tends to sink to the bottom of either tank 28 or filter trough 54. Working fluid is flowed from the pumps 30 and 32 directly into the collecting portion 42 of tank 28 to agitate the fluid in the tank and stir up the gel so that it is circulated over the drum 14.

Gel collecting or forming in the interior of trough 54 tends to collect at the low point 72 defined by the intersections of the inner surfaces of the front and bottom walls and is drawn therefrom with the working fluid into the interstices of the walls of the filter trough. Continued flowing of gel into the walls tends to fill or clog the lower most portions of the trough with gel. Because the gel collects at the low point 72 the walls adjacent that point are clogged first. For instance, in FIG. 5, the portion of the filter trough below line 74 is first clogged with gelled working fluid and, with subsequent flowing of working fluid and gel into the filter trough, the areas below lines 76, 78 and 80 are successively filled with gel. Excess gel 82 may also collect in the trough at the low point. The working fluid in the filter trough is preferably not agitated. This allows the gel to sink and collect at low point 72.

The thick walled construction of filter trough 54 provides a large filtration volume for the working fluid adjacent the trough low point 72 with somewhat decreased flow volumes for the fluid moving through the filter trough away from the low point. This construction permits a relatively large amount of gel to be trapped within the walls of the filter trough with a relatively minimal decrease in in the filtering efficiency of the trough. The walls 56 and 60 intersect at an acute angle defining the low point to provide a gel confining or collecting area. The gel collected at the low point has a minimal effect on the efficiency of filter trough, particularly after the photocopy machine has been used sufficiently to fill the clog the adjacent filter trough side walls with gel.

Excessive continued use of photocopying machine 10 with a single charge of working solution may clog the filter 12 sufficiently to reduce the flow through the trough side walls below the rate in which the working fluid is supplied to the trough from drum 14. In this event, the level of the liquid in the trough will rise and the excess will be discharged from the trough back into the collecting portion of tank 28 through the overflow 70.

The photocopier described herein may be used with a number of commercially available photocopy machines using transfer processes where a toner fluid is flowed over a transfer surface. Savin Business Machines Corporation markets a photocopier of this type.

While I have illustrated and described preferred embodiment of my invention, it is understood that this is capable of modification, and I therefore do not wish to be limited to the precise details set forth, but desire to avail myself of such changes and alterations as fall within the purview of the following claims.

What I claim my invention is:

1. A photocopy machine wherein a working fluid is applied to a developing device in a developmental process, the machine comprising a container for receiving the working fluid which has been used in the developmental process; means for pumping the working fluid from the container to the developing device; and a filter trough for removing impurities and gel from the working fluid, said filter trough being disposed within said container in the path of gravity flow of working fluid from the developing device back to the container so that the filter trough collects such returned working fluid, the filter trough comprising an integral body of foamed polyurethane plastic having a generally rectangular horizontal cross-section, an open top, a side wall extending around the trough, a bottom wall and an overflow channel in the top of the side wall, the interior surfaces of the body defining an interior low point located below the upper surface of the working fluid in the container when the photocopy machine is in use, the trough forming a filter including a permeable thick collecting body extending from adjacent the low point upwardly toward the top of the trough for removing impurities and gel from the working fluid, said low point defining a location in the trough for collection of excess gel.

2. A photocopy machine of the type using a developing device over which a working liquid is distributed, a tank located below the device, a pump extending into the tank and a conduit for flowing working liquid for pumping the liquid from the tank and flowing the pumped liquid over the device, wherein the improvement comprises a unitary rectangular filter trough located within the tank beneath the device, having an open top, a side wall extending around the trough and a flat bottom wall, the trough having an interior low point adjacent the intersection of the bottom and side wall and below the upper surface of the working liquid in the tank when the photocopy machine is in use, filter means having a thick filtering body through which the working fluid flows from the trough back to the tank, and an overflow opening adjacent to the top of the side wall, whereby upon operation of the photocopy machine the pump draws liquid from the tank remote from the trough and flows it over the device so that at least a portion of the liquid falls into the filter trough and is gravity-filtered through the thickness of the body to remove impurities and gel prior to flowing back into the tank for recirculation and excess gel is collected in the filter trough at the low point.

3. A photocopy machine using a working liquid and having a developing device; a tank located beneath the device; and pumping means for pumping working liquid from the tank and flowing the pumped liquid over the device so that excess working liquid falls back into the tank, wherein the improvement comprises an open topped filter trough located within the tank beneath the device, the filter trough having a bottom wall and a side wall and including a thick permeable capturing filter extending up the side wall from the bottom wall toward the top of the trough, the capturing filter having interior and exterior surfaces and an interior filter volume comprising interstices joining said interior and exterior surfaces, whereby excess working fluid gravity flows into said trough and raises the level of fluid in the trough above the level of the working fluid in the tank to establish a gravity pressure differential across the filter to draw working liquid through the filter and into the tank while trapping impurities and gel in the interstices and collecting excess gel at the bottom of the trough.

4. A photocopy machine as in claim 3 including an overflow passage in the top of the trough.

5. In a photocopy machine the method of cleaning working liquid flowed over a developing device comprising the steps of:

A. flowing the working liquid from a collection tank over the developing device;

B. gravity flowing excess working liquid from the developing device into an open trough located within the tank and having a low point and a thick filter extending upwardly from the low point toward the top of the trough with the internal interstices communicating the interior and exterior sides of the filter;

C. raising the level of the liquid in the trough above the level of the liquid in the tank to establish a pressure differential across the filter;

D. gravity flowing the liquid past the interior surface of the filter, through the interstices of the filter, out the exterior surface of the filter and into the collection tank while capturing gel and impurities carried by the liquid within the interstices of filter.

6. The method of claim 5 including the step of:

E. flowing gel from the interior of the trough into the filter adjacent the low point to first clog the filter at the low point and then clog the filter progressively further away from the low point while maintaining the remote portion of the filter free for non-clogging filtration of impurities and gel.

7. The method of claim 6 including the step of filling all of the interstices and then flowing liquid from the trough over the top of the side of the filter and back into the tank.

* * * * *